United States Patent [19]

Hamai et al.

[11] Patent Number: 4,851,734

[45] Date of Patent: Jul. 25, 1989

[54] FLAT FLUORESCENT LAMP HAVING TRANSPARENT ELECTRODES

[75] Inventors: Jitsuo Hamai; Hiroyuki Hamai, both of Tokyo; Eiichi Asami, Yamagata, all of Japan

[73] Assignee: Hamai Electric Co., Ltd., Tokyo, Japan

[21] Appl. No.: 123,150

[22] Filed: Nov. 20, 1987

[30] Foreign Application Priority Data

Nov. 26, 1986 [JP] Japan ..... 61-281326
Nov. 26, 1986 [JP] Japan ..... 61-281327

[51] Int. Cl.[4] ..... H01J 63/02; H01J 61/067

[52] U.S. Cl. ..... 313/485; 313/491; 313/493; 313/607; 313/331

[58] Field of Search ..... 313/485, 495, 491, 512, 313/607, 331, 619, 620, 381-383, 493, 496; 427/66, 67; 315/248, 169.4

[56] References Cited

U.S. PATENT DOCUMENTS 2,901,652 8/1959 Fridrich ..... 313/512 X
3,562,737 2/1971 Wiederhorn et al. ..... 313/485 X
3,589,789 6/1971 Hubert ..... 313/485 X
4,206,382 6/1980 DuBois ..... 313/496
4,218,632 8/1980 Ernsthausen et al. ..... 313/484
4,266,167 5/1981 Proud et al. ..... 315/248
4,565,948 1/1986 Kimura et al. ..... 313/487
4,617,195 10/1986 Mental ..... 313/512 X

FOREIGN PATENT DOCUMENTS 154740 9/1984 Japan ..... 313/495

*Primary Examiner*—Donald J. Yusko
*Assistant Examiner*—Michael Horabik
*Attorney, Agent, or Firm*—Flynn, Thiel, Boutell & Tanis

[57] ABSTRACT

A flat fluorescent lamp having transparent electrodes, transparent glass plates spaced vertically apart and confronting each other, transparent conductive films forming electrodes provided on the outer surface or the inner surface of the glass plates, fluorescent paint layers provided fixedly on the inner side of the glass plates, or on the glass plates via the transparent conductive films by coating the fluorescent paint on the inner surfaces of the glass plates or conductive films, glass frames spaced horizontally close to both ends of the transparent glass plates or the transparent conductive films and fixedly mounted on the glass plates or transparent conductive films, a space surounded by the glass plates or the transparent conductive films and the glass frames for sealing gas, generally an inert gas therein, and lead-in wires clamping one end of the glass plates and the transparent conductive films.

8 Claims, 2 Drawing Sheets

FLAT FLUORESCENT LAMP HAVING TRANSPARENT ELECTRODES

BACKGROUND OF THE INVENTION

1. Field of the Invention

The present invention relates to a flat fluorescent lamp having transparent electrodes, more particularly to a flat fluorescent lamp having transparent electrodes for use in a reverside illumination of a transparent liquid crystal display.

2. Prior Art

There have been three types of lamps for use in a reverside illumination of a liquid crystal display.

First is a cold cathode type fluorescent lamp for use in a reverside illumination of a transparent liquid crystal display. The first lamp has a problem in that the illumination is effected unevenly and a lamp for use in a reverside illumination is thick. There has also been known a lamp bulb type fluorescent lamp for use in a reverside illumination of a transparent liquid crystal display. The second has a problem in generating heat and so on in addition to the problem just mentioned above. To solve the problems mentioned above, there has been a need to prepare the reverside illumination for a liquid crystal display having a thin flat surface and capable of uniformly illuminating the whole of the liquid crystal display without generating heat. There has further been known a cold cathode type flat fluorescent lamp for use in reverside illumination and developed recently which has electrodes at both ends thereof in a horizontally spaced relation. Thus the third fluorescent lamp needs a high luminous voltage because the distance between two electrodes is long so that the discharge is effected horizontally from both ends of the lamp.

SUMMARY OF THE INVENTION

It is therefore a first object of the present invention to solve the problems in the first, second and third flat fluorescent lamps having transparent electrodes for use in reverside illumination thereof.

It is a second object of the present invention to provide a flat fluorescent lamp having transparent electrodes which electrodes are spaced equally and at a small distance relative to a flat surface of the lamp, so that uniform and flat illumination is obtained compared with a conventional cold cathode fluorescent lamp without need of a reflecting mirror or a diffuse reflector.

It is a third object of the present invention to provide a flat fluorescent lamp having transparent electrodes including no electrodes inside the fluorescent lamp whereby a generation of gas from electrodes and sublimation of electrode metal is prevented, so that the span of life of the lamp is lengthened irrespective of the intensity of illumination.

It is a fourth object of the present invention to provide a flat fluorescent lamp having transparent electrodes which electrodes are made of a transparent conductive film capable of being fixed directly to the luminous surface, so that the distance between the electrodes is set to several milimeters irrespective of the size of the luminous surface, furthermore the electrodes are vertically arranged to enable discharge in a vertical relation and the interval of discharge is extremely shortened compared with conventional lamps.

It is a fifth object of the present invention to provide a flat fluorescent lamp having transparent electrodes which electrodes are spaced a short distance apart so that the lamp is illuminated with low voltage and which area is so large that the lamp is operated efficiently with low electric power without consumption of heat energy caused by local electron emission.

The flat fluorescent lamp having transparent electrodes according to the present invention comprises transparent glass plates forming luminous surfaces spaced vertically and facing each other, transparent conductive films forming electrodes provided on the outer surface or the inner surface of the glass plates, fluorescent paint layers provided fixedly on the inner side of the glass plates or on the glass plate via the transparent conductive films by coating the fluorescent paint with three spectral colours on the inner surfaces of the glass plates or conductive films, glass frames spaced horizontally close to both ends of the transparent glass plates or the transparent conductive films and fixedly mounted on the glass plates or transparent conductive films, a space surrounded by the glass plates or the transparent conductive films and the glass frames for sealing gas, generally an inert gas in the amount appropriate to effect a glow discharge therein, and lead-in wires clamping one end of the glass plates and the transparent conductive films.

The above and other objects, features and advantages of the present invention will become more apparent from the following description when taken in conjunction with the accompanying drawings in which preferred embodiments of the present invention are shown by way of illustrative examples.

DESCRIPTION OF THE PREFERRED EMBODIMENT

Figure 1:
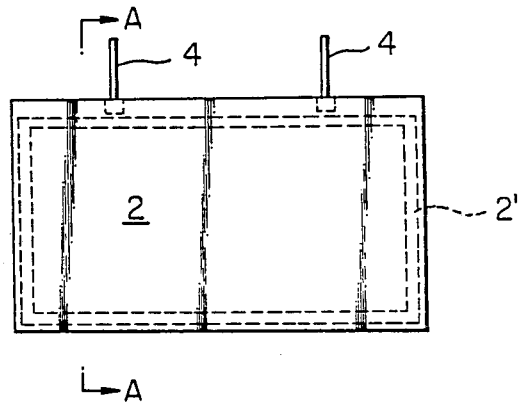
FIG. 1 is a plan view of the flat fluorescent lamp having transparent electrodes according to an embodiment of the present invention.
Figure 2:
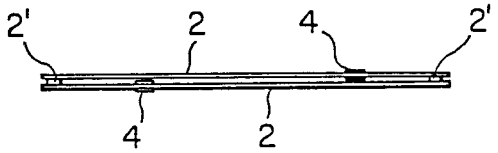
FIG. 2 is a cross sectional view taken along line A—A of the flat fluorescent lamp having transparent electrodes in FIG. 1.
Figure 3:
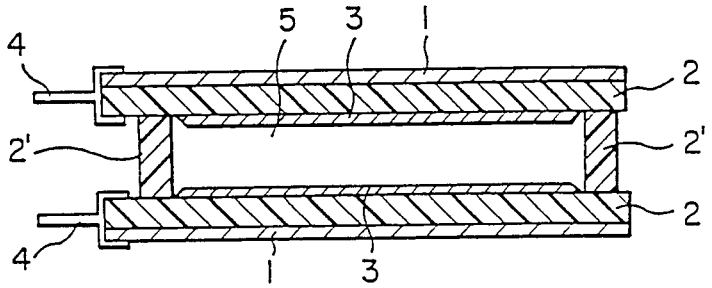
FIG. 3 is an enlarged cross sectional view of a first embodiment of the present invention.

A first embodiment of the present invention will be described with reference to FIGS. 1 to 3.

The flat fluorescent lamp having transparent electrodes according to the first embodiment comprises transparent glass plates 2, 2 forming luminous surfaces, spaced vertically apart and confronting each other, glass frames 2', 2' spaced horizontally close to both ends of the transparent glass plates 2, 2 and fixedly mounted on the transparent glass plates 2, 2, a space 5 surrounded by the glass plates 2, 2 and the glass frames 2', 2' for sealing gas therein, generally an inert gas therein in an amount appropriately to effect a glow discharge, fluorescent paint layers 3, 3 defined on the inner surfaces of each of the glass plates 2, 2 by coating the fluorescent paint with three spectral colours on the inner surfaces of the glass plates 2, 2, and transparent conductive films 1, 1 forming electrodes and provided on outer surfaces of the glass plates 2, 2 and lead-in wires 4, 4 clamping one end of the glass plates 2, 2 and the transparent conductive films 1, 1.

As evident from the arrangement of the flat fluorescent lamp having transparent electrodes, the transparent conductive films 1, 1 are provided on the outer surfaces of the two glass plates 2, 2 so that the distance between the two glass plates 2, 2 can be shortened whereby an extremely thin, flat, fluorescent lamp can be manufactured.

Figure 4:
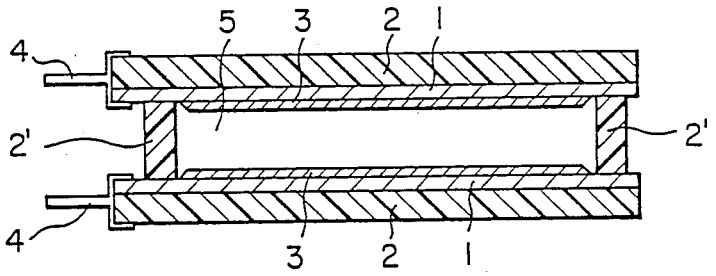
FIG. 4 is an enlarged cross sectional view of a second embodiment of the present ivention.

A second embodiment of the present invention will be described with reference to FIG. 4.

The flat fluorescent lamp having transparent electrodes according to the second embodiment comprises transparent glass plates 2, 2 forming luminous surfaces spaced vertically apart and confronting each other, transparent conductive films 1, 1 forming electrodes provided on inner surfaces of the glass plates 2, 2, fluorescent paint layers 3, 3 defined on the transparent conductive films 1, 1 by coating the fluorescent paint with three spectral colours on the inner surfaces of the glass plates 2, 2, glass frames 2', 2' spaced horizontally close to both ends of the fluorescent paint layers 3, 3 and fixedly mounted on the fluorescent paint layers 3, 3, a space 5 surrounded by the fluorescent paint layers 3, 3 and the glass frames 2', 2' for sealing gas, generally an inert gas in the amount appropriately to effect a glow discharge therein, and lead-in wires 4, 4 clamping one end of the glass plates 2, 2 and the transparent conductive films 1, 1.

Figure 5:
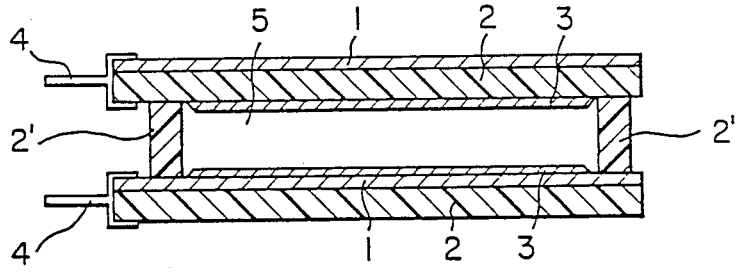
FIG. 5 is an enlarged cross sectional view of a third embodiment of the present invention.

A third embodiment of the present invention will be described with reference to FIG. 5.

The flat fluorescent lamp having transparent electrodes according to the third embodiment comprises transparent glass plates 2, 2 forming luminous surfaces spaced vertically apart and confronting each other, a transparent conductive film 1 forming an electrode provided on an inner surface of one of glass plates 2, 2, a fluorescent paint layer 3 defined on the conductive film 1 by coating the fluorescent paint with three spectral colours on the surface of the conductive film 1, a fluorescent paint layer 3 defined in an inner surface of one of the glass plates 2, 2, a conductive film 1 forming an electrode provided on the outer surface of one of the glass plates 2, 2, glass frames 2', 2' spaced horizontally close to both ends of the transparent conductive film 1 and the glass plate 2 and fixedly mounted on the conductive film 1 and one of the glass plate 2, 2, a space 5 for sealing gas, generally an inert gas in an amount appropriate to effect a glow discharge and surrounded by the conductive film 1, one of the glass plates 2, 2, and the glass frames 2', 2', and lead-in wires 4, 4 clamping one end of the glass plates 2, 2 and the transparent conductive films 1, 1.

Although a certain preferred embodiment has been shown and described, it should be understood that many changes and modifications may be made therein without departing from the scope of the appended claims.

What is claimed is:

1. A flat fluorescent lamp having transparent electrodes comprising: a pair of transparent glass plates spaced vertically apart and having inner planar surfaces positioned in parallel and face-to-face relationship; a first transparent conductive film forming an electrode provided on and covering the inner planar surface of one of the transparent glass plates; a second transparent conductive film forming an electrode provided on and covering the inner planar surface of the other transparent glass plate; a glass frame positioned and fixedly mounted between said pair of transparent glass plates, said glass frame and first and second transparent conductive films forming a sealed chamber defining a space therein for containing a gas; fluorescent paint layers provided on the surfaces of said first and second transparent conductive films that are contained within said sealed chamber; and lead-in wires clamping one end of the glass plates and the transparent conductive film.

2. A flat fluorescent lamp having transparent electrodes according to claim 1, wherein inert gas is contained in said space in an amount to effect glow discharge therein.

3. A flat fluorescent lamp having transparent electrodes according to claim 1, wherein said paint has three spectral colours.

4. A flat fluorescent lamp having transparent electrodes according to claim 1 wherein said conductive films are spaced apart in vertical face-to-face relationship with each other at a distance of several millimeters.

5. A flat fluorescent lamp having transparent electrodes comprising: a pair of transparent glass plates spaced vertically apart, each of said transparent glass plates having planar inner and outer surfaces which are parallel to each other, said planar inner surfaces of said transparent glass plates being positioned in parallel and face-to-face relationship; a first transparent conductive film forming an electrode provided on and covering the inner planar surface of one of the transparent glass plates; a second transparent conductive film forming an electrode provided on and covering the outer planar surface of the other transparent glass plate; a glass frame positioned and fixedly mounted between said pair of transparent glass plates, said glass frame, said first transparent conductive film and said inner planar surface of said other transparent glass plate forming a sealed chamber defining a space therein for containing a gas; fluorescent paint layers provided on the surfaces of said transparent conductive film and said inner planar surface of said other transparent glass plate that are contained within said sealed container; and lead-in wires clamping one end of the glass plates and the transparent conductive films.

6. A flat fluorescent lamp having transparent electrodes according to claim 5, wherein inert gas is contained in said space in an amount to effect glow discharge therein.

7. A flat fluorescent lamp having transparent electrodes according to claim 5, wherein said paint has three spectral colours.

8. A flat fluorescent lamp having transparent electrodes according to claim 5, wherein said conductive films are spaced apart in vertical face-to-face relationship with each other at a distance of several millimeters.

* * * * *